US005207082A

United States Patent [19]

LeMaitre

[11] Patent Number: 5,207,082

[45] Date of Patent: May 4, 1993

[54] KEY HOLDING DEVICE

[76] Inventor: Thomas H. LeMaitre, 259 Butterworth La., Langhorne, Pa. 19047

[21] Appl. No.: 865,255

[22] Filed: Apr. 8, 1992

[51] Int. Cl.[5] ..... E05B 19/00

[52] U.S. Cl. ..... 70/408; 70/456 R

[58] Field of Search ..... 70/408, 458, 456 R, 70/456 B, 457, 459, 454, 453; 206/37.1-37.8, 38.1; 16/115

[56] References Cited

U.S. PATENT DOCUMENTS

| | | | |
|---|---|---|---|
| 104,223 | 6/1870 | Brady . | |
| 742,448 | 10/1903 | Konrad | 16/115 |
| 1,473,186 | 11/1923 | Johnsgaard | 16/115 |
| 2,002,818 | 5/1935 | Jones | 70/456 R |
| 2,210,048 | 8/1940 | Swanson | 70/456 R |
| 4,351,173 | 9/1982 | Toyoda | 70/465 R |
| 4,569,215 | 2/1986 | McCarthy | 70/456 |
| 4,583,383 | 4/1986 | Bosco et al. | 70/408 |
| 4,637,238 | 1/1987 | Uda et al. | 70/456 R |
| 4,901,548 | 2/1990 | Deslandes | 70/408 |
| 4,910,983 | 3/1990 | Taylor | 70/408 |
| 5,046,343 | 9/1991 | Miwa | 70/408 |
| 5,058,465 | 10/1991 | Womack | 70/408 |

FOREIGN PATENT DOCUMENTS

| | | | |
|---|---|---|---|
| 476241 | 5/1929 | Fed. Rep. of Germany | 70/453 |
| 3242766 | 5/1984 | Fed. Rep. of Germany | 70/456 R |
| 3437439 | 4/1986 | Fed. Rep. of Germany | 70/379 R |
| 2597537 | 10/1987 | France | 70/257 |

*Primary Examiner*—Peter M. Cuomo
*Assistant Examiner*—Darnell Boucher
*Attorney, Agent, or Firm*—Jack D. Puffer

[57] ABSTRACT

A key holder in which a key may be fastened, includes an elongated handle for providing the user with a mechanical advantage in operating key locks. The key is retained in the holder by means of a pin inserted in the key ring hole in the bow of the key. The key is clamped in the body of the holder by a set screw operating on a clamping plate located in the key receiving opening of the body of the holder. The handle may be fixed in the body or made slidable for the convenience of the user.

8 Claims, 3 Drawing Sheets

KEY HOLDING DEVICE

BACKGROUND OF THE INVENTION

This invention relates in general to devices for holding keys used for operating locks on doors or similar locked openings and in particular, to devices which enable persons having infirmities which make it difficult for them to grip small objects and manipulate them, to easily unlock and open doors. Typical of such infirmities causing these difficulties is arthritis which affects a large number of older people.

Standard keys in use today are typically composed of a blade portion having coded notches matching the tumblers of the lock mechanism which it opens, a stop shoulder on at least one side to insure proper depth of insertion in the lock and an enlarged bow or head portion for gripping and turning the key. While the bow portion is usually of sufficient size for the average person to exert the lock-turning torque required to unlock a door, a person handicapped by arthritis in the joints of the fingers may be unable to operate the lock without mechanical assistance. In addition, many of the older buildings of today provide only a standard round knob for unlatching the door after unlocking it. Persons afflicted with arthritis or similar handicaps have considerable difficulty in operating such knobs after the key has been successfully manipulated.

The invention described herein provides a holder for keys of various sizes which assists a handicapped person in turning a key when operating door locks and, in addition, provides a handle of a design which also assists in pulling the door open after the lock has been operated. This invention provides a means for easily attaching any key to the handle by means of the key chain hole provided in the bow portion of keys and enables the user to pull the door open using the key holder. In addition, the key holder gives the user a mechanical advantage for turning the key by means of an elongated lever attached to the key-holding portion. The invention allows easy and quick attachment of the key to the holder requiring only a standard screwdriver to clamp the key in the holder. The screw portion of the clamping assembly is captured in the key-holding portion such that it will not be inadvertently dropped during installation of a new key.

SUMMARY OF THE INVENTION

The present invention overcomes the disadvantages of the prior art devices by providing a holder for various size keys which fixes the key in the holder utilizing the standard key chain hole provided in most standard keys today. The key is clamped in the holder by a key clamping pad engaged by use of a simple set screw readily available on the outside of the device. The elongated handle of the device extends from the key-holding body to provide a mechanical advantage for the user in turning the lock to unlock the door. In one embodiment of the invention, the handle is made slidable in the key-holding body so that the handle may be centered on the key-holding body and the handle used to pull the door open after the lock has been operated by the extended handle. In another embodiment, the handle is made in a unitary piece which is formed at a 90° angle to the long axis of the handle. This portion of the handle then serves as part of the clamping assembly for maintaining the key in the holder.

DETAILED DESCRIPTION OF THE PREFERRED EMBODIMENTS

Figure 1:
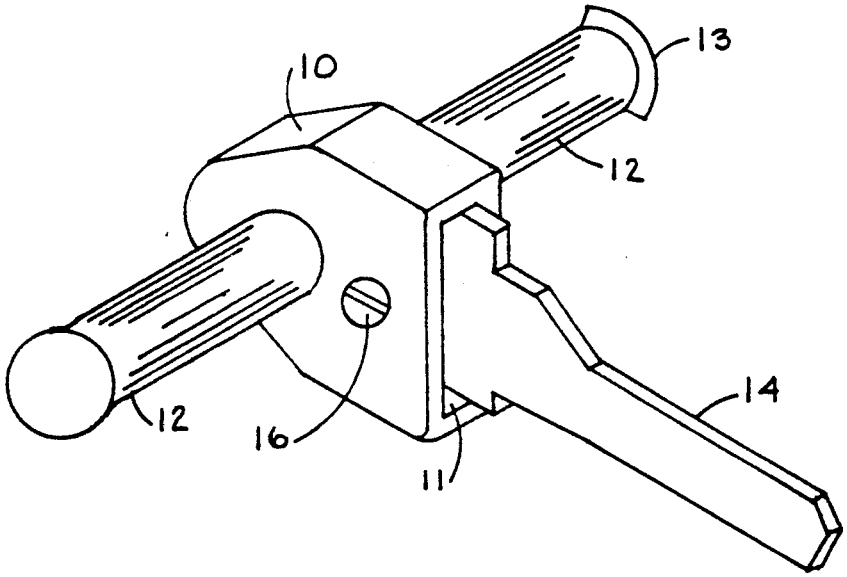
FIG. 1 is an isometric view of a key holder according to the invention.
Figure 2:
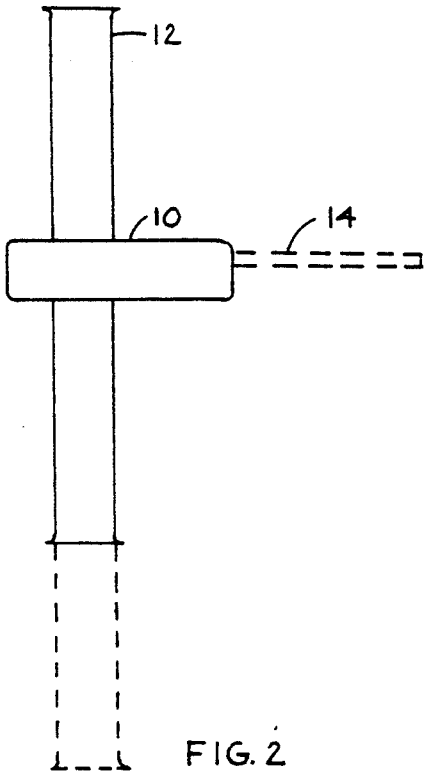
FIG. 2 is a plan view of the preferred embodiment of the invention.
Figure 3:
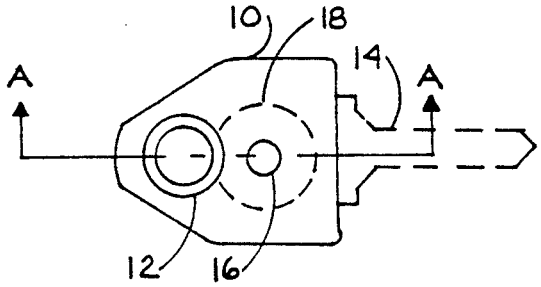
FIG. 3 is an elevation view of the device of FIG. 1.
Figure 4:
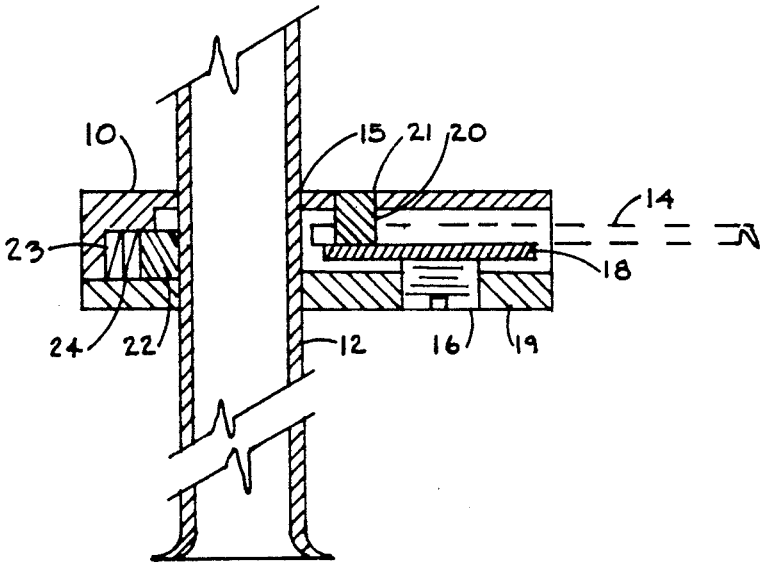
FIG. 4 is a partial sectional view taken along line A—A of FIG. 3.

Referring now to FIG. 1, there is shown an isometric view of one embodiment of the invention. The key holder of the invention consists of a body member 10 having a key-receiving opening 11 in its forward face. A key 14 is shown schematically inserted in the key-receiving opening. The key is retained in the body member by means of a set screw 16 which operates the key clamping member which is described in more detail in connection with the discussion of FIGS. 3–4 below. A handle member 12 is inserted in the body member 10. In the embodiment shown in FIGS. 1–4, the handle 12 is slidable in the body member 10. The ends of the handle 12 are flared slightly as shown at 13 to prevent the handle from falling out of the body member. In addition, there is provided in the body member 10, a frictional restraint to cause the handle to remain in the position selected by the user rather than freely sliding back and fourth and the device is tipped in one direction or the other. The details of the frictional restraint are described in detail in connection with the discussion of FIG. 4 given below. FIGS. 2 and 3 are plan and elevation projections of the device shown in FIG. 1. In FIG. 2, the handle is shown in phantom view in the extended position used to provide a mechanical advantage for turning the key in the lock. The handle is shown in the centered position in solid lines in FIG. 2. In this position, the key holder of the invention may be used to pull a door to the open position after the key has been manipulated to unlock the lock.

Referring now to FIG. 4, there is shown a partial sectional view taken along line A—A of FIG. 3. The body member 10 is shown in section with the handle 12 passing through the opening 15 in the body member. The key 14 shown in phantom lines, is retained in the body member by means of a pin 20 attached to one side of an interior wall of the key-receiving opening in the body member. The pin 20 is inserted in the standard key-ring hole provided in most standard keys. If it is desired to use the invention with a key not having a key ring hole, a hole of approximately ⅛ inch diameter can be drilled through the bow of the key. The pin 20 is sized to be a press fit in the hole 21 of the body member. The key clamping device is composed of a set screw 16 which is threaded into a tapped hole in the wall 19 of the body member 10. Attached, to the distal end of the screw 16 is a key-clamping disc or plate 18. The disc 18 is attached to the screw 16 by resistance welding or other well known attachment means. A hole 23 is provided in the rearward portion of the body member 10 for receiving the frictional restraint assembly discussed earlier in connection with FIG. 1. The restraint assembly consists of a pin 22 which is forced into sliding engagement with the handle 12 by means of spring 24. The spring forces the pin against the outer surface of the handle 12 to prevent free sliding of the handle in the body member. However, the restraint is designed to be easily overcome by the user pushing the handle in the desired direction.

With the key assembled into the body member and securely restrained by the clamping device, the device is operated as follows. First the handle 12 is moved in the body 10 to one extreme end depending on the orientation of the lock to be opened. The key is inserted in the lock to its limit stops and the key turned by exerting downward pressure on the extended handle. Next, the handle 12 is moved to an approximately centered position in the body member and the user may then grasp the centered handle and pull the door open. Of course, the door may also be pulled open with the handle left in the extreme position.

Figure 5:
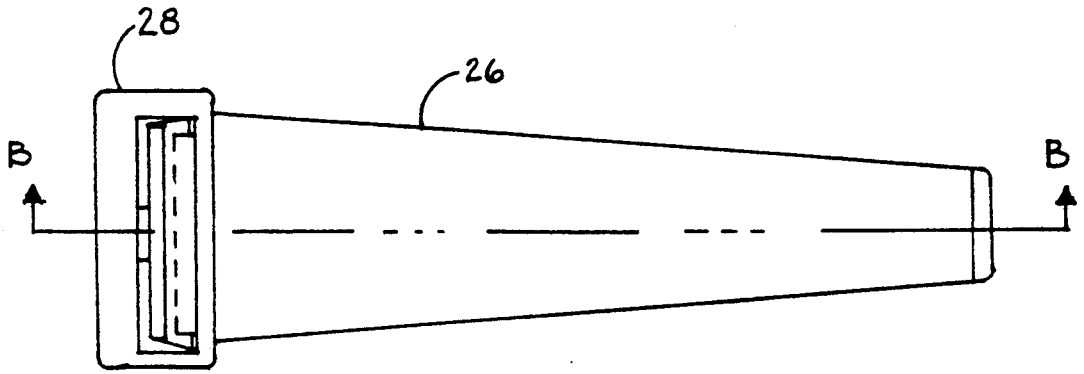
FIG. 5 is a plan view of another embodiment of the invention.
Figure 6:
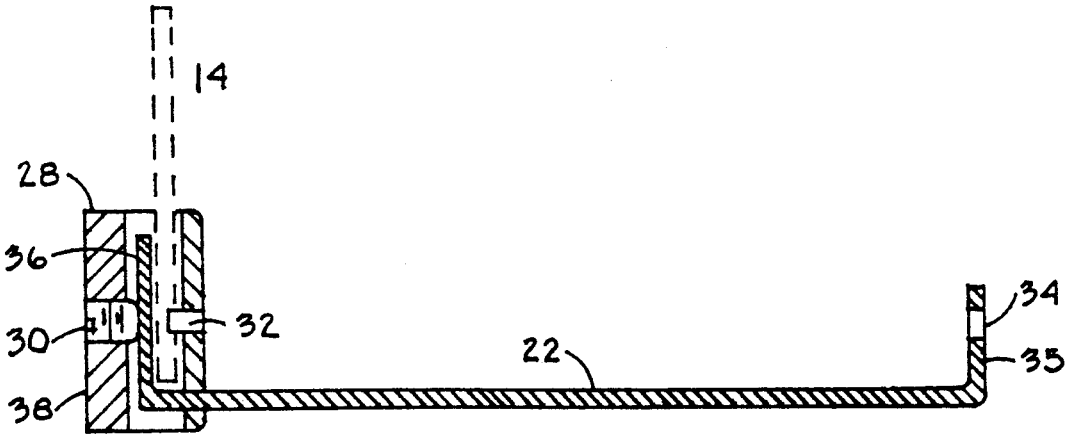
FIG. 6 is a sectional view taken along line B—B of FIG. 5.

Referring now to FIGS. 5 and 6, there is shown another embodiment of the invention. In this embodiment, the handle 26 is made of a single piece of material turned up at approximately a right angle at both ends to form a generally U shaped element. At the distal end, the turned up portion is relatively small and provides a stop to prevent the device from slipping from the hand of the user. This turned up portion is provided with a hole 34 to allow the device to be attached to a key chain or other key-carrying means. At the other end, the turned up portion 36 is larger and serves as part of the key clamping assembly which will be discussed in more detail below. A body portion 28 is formed in a rectangular box shape having a key-receiving opening extending through the body. The body is provided at one side with a set screw 30 which is threaded into a tapped hole in the wall 38 of the body member. In the opposite wall of the body member 28 there is provided a pin 32 firmly secured in the interior wall of the body member by press fitting or other well known attachment means. In the operation of this embodiment, a key, provided with a key-ring hole as discussed in connection with FIG. 4 above, is inserted into the opening of the body member 28 and the hole in the key is matched to the pin 32 to hold the key in the holder. Next the larger turned up portion 36 of the handle 22 is inserted in the opening of the body member between the key and the interior surface of the wall 38 of body member 28. The set screw 30 is then turned to clamp the key 14 securely in the holder. The operation of the device is substantially the same as that described in connection with the first embodiment. However, in this embodiment the handle is fixed in the extended position and may be used for both turning the key in the lock and pulling the door open.

Thus it can be seen that there are herein provided embodiments of a key-holding device which will enable persons having restricted use of their fingers and hands to operate most keyed locks and easily open the door after manipulating the lock.

What is claimed is:

1. A key holder for holding a lock operating key having an attachment hole in the bow thereof, said holder comprising:

a body having a rectangular key receiving opening therein, said opening having its longer dimension substantially vertical in the operating position;

key retaining means within said opening for retaining said key in the holder, said retaining means comprising a pin extending in said opening from one interior wall of said opening, said pin being arranged for insertion in the attachment hole of said key;

key clamping means within said opening for securing said key in contact with said retaining means, said clamping means comprising a clamping plate within said opening on the opposite side of the key from said retaining means, and a screw threaded into the wall of the body opposite the retaining means and extending therethrough and attached at its inner end to said clamping plate and rotatable therewith; and an elongated handle attached to said body, the long dimension of said handle being substantially transverse to the long dimension of said opening said handle being slidably attached to said body in a handle mounting hole extending transversely through said body for free movement of said handle along its length.

2. The key holder according to claim 1 and further comprising stop means at both ends of said handle for keeping said handle in said body.

3. The key holder according to claim 2 and further comprising friction inducing means in said body for applying a frictional force to said handle for restraining motion of said handle.

4. The key holder according to claim 3 wherein said friction inducing means comprises a pin slidably mounted in a hole in the interior end wall of said body opening and intersecting said handle mounting hole at approximately 90° and a spring mounted between said pin and the bottom of said hole for urging said pin into contact with said handle within said body.

5. A key holder for holding a lock operating key having an attachment hole in the bow thereof, said holder comprising:

a body having a rectangular key receiving opening therein, said opening having its longer dimension substantially vertical in the operating position;

key retaining means within said opening for retaining said key in the holder;

key clamping means within said opening for securing said key in contact with said retaining means; and an elongated handle attached to said body, wherein said handle is slidably attached to said body in a handle mounting hole extending transversely through said body for free movement of said handle along its length, the long dimension of said handle being substantially transverse to the long dimension of said opening.

6. The key holder according to claim 5 and further comprising stop means at both ends of said handle for keeping said handle in said body.

7. The key holder according to claim 6 and further comprising friction inducing means in said body for applying a frictional force to said handle for restraining motion of said handle.

8. The key holder according to claim 7 wherein said friction inducing means comprises a pin slidably mounted in a hole in the interior end wall of said body opening and intersecting said handle mounting hole at approximately 90° and a spring mounted between said pin and the bottom of said hole for urging said pin into contact with said handle within said body.

* * * * *